US007995956B2

(12) United States Patent
Stelter

(10) Patent No.: US 7,995,956 B2
(45) Date of Patent: Aug. 9, 2011

(54) DEVELOPER SYSTEM AND METHOD FOR PROVIDING VARIABLE FLOW RATE OF DEVELOPER IN AN ELECTROGRAPHIC PRINTER

(75) Inventor: Eric C. Stelter, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 4 days.

(21) Appl. No.: 12/484,392

(22) Filed: Jun. 15, 2009

(65) Prior Publication Data

US 2010/0316415 A1 Dec. 16, 2010

(51) Int. Cl.
*G03G 15/09* (2006.01)

(52) U.S. Cl. ..... 399/272; 399/53; 399/277

(58) Field of Classification Search ..... 399/272, 399/267, 53, 277
See application file for complete search history.

(56) References Cited

U.S. PATENT DOCUMENTS

| | | | | |
|---|---|---|---|---|
| 4,378,158 | A | 3/1983 | Kanbe | 399/281 |
| 5,115,276 | A * | 5/1992 | Miskinis et al. | 399/272 |
| 5,768,667 | A * | 6/1998 | Bessette | 399/277 X |
| 7,426,361 | B2 | 9/2008 | Thompson et al. | 399/254 |
| 7,481,884 | B2 | 1/2009 | Stelter et al. | 118/247 |
| 2008/0112732 | A1 * | 5/2008 | Stelter et al. | 399/272 |
| 2008/0285985 | A1 | 11/2008 | Park | 399/27 |
| 2009/0022524 | A1 * | 1/2009 | Klassen | 399/272 |
| 2009/0269094 | A1 * | 10/2009 | Mitsui | 399/53 |

FOREIGN PATENT DOCUMENTS

| | | | |
|---|---|---|---|
| JP | 57 185052 | A | 11/1982 |
| JP | 03-200991 | A * | 9/1991 |
| WO | WO 92/22020 | A2 | 12/1992 |

* cited by examiner

*Primary Examiner* — Sophia S Chen
(74) *Attorney, Agent, or Firm* — Donna P. Suchy

(57) ABSTRACT

A developer system and method for an electrographic printer is provided that provides a variable rate of developer flow to the photoconductor drum of the printer. The system includes a magnetic brush having a magnetic core surrounded by a toning shell that rotatably conveys a layer of developer to the photoconductor element; a sump containing a reservoir of developer, and a variable speed conveyor roller.

18 Claims, 8 Drawing Sheets

DEVELOPER SYSTEM AND METHOD FOR PROVIDING VARIABLE FLOW RATE OF DEVELOPER IN AN ELECTROGRAPHIC PRINTER

CROSS REFERENCE TO RELATED APPLICATIONS

This application relates to commonly assigned, copending U.S. application Ser. No. 12/484,397, filed Jun. 15, 2009, entitled: "SYSTEM AND METHOD FOR PROVIDING A STABLE AND HIGH FLOW RATE OF DEVELOPER IN AN ELECTROGRAPHIC PRINTER" and U.S. application Ser. No. 12/484,409, filed Jun. 15, 2009, entitled: "DEVELOPER SYSTEM AND METHOD FOR PROVIDING A STABLE FLOW RATE OF DEVELOPER IN AN ELECTROGRAPHIC PRINTER."

FIELD OF THE INVENTION

This invention generally relates to electrographic printers, and is specifically concerned with a system and method that provides stable image quality by controlling the flow rate of developer to the magnetic brush of a developer station through the use of a conveyor roller operating at a preferred variable speed range.

BACKGROUND OF THE INVENTION

Electrographic printers that use a rotating magnetic brush to apply a dry, particulate developer to a photoconductor member are known in the art. In such electrographic printers, the magnetic brush includes a rotatable magnetic core surrounded by a rotatable, cylindrical toning shell. The toning shell may be eccentrically mounted with respect to the axis of rotation of the magnetic core. The eccentric mounting of the toning shell defines an area of relatively strong magnetic flux where the shell corners closest to the magnetic core, and an area of relatively weak magnetic flux where the shell is farthest away from the core. The magnetic brush is mounted over a developer sump that holds a reservoir of dry, two-component developer including a mixture of ferromagnetic transport particles and toner particles capable of holding an electrostatic charge. A rotatable conveyor roller is disposed between the reservoir of developer in the sump and the toning shell. In operation, the rotatable conveyor roller attracts and transports developer from the sump to a region of the toning shell where the magnetic flux is relatively weak. The rotating toning shell in turn transports the developer toward the photoconductor member. At the line of closest approach between the toning shell and the photoconductor member, the particulate toner component of the developer is transferred to the photoconductor member as a result of electrostatic attraction between the toner particles and the electrostatic field on the photoconductor member and consequently develops a latent electrostatic image on the photoconductor member. The developed image is ultimately transferred to a substrate, such as a sheet of paper, where the toner image is fused into a permanent image via a fuser station. The combination of the magnetic brush, developer sump and conveyor roller is referred to as a developer station in this application.

In order to print images as quickly as possible, it is necessary for the conveyor roller to rapidly deliver developer to the toning shell. However, it is also necessary for the toning shell to deliver a constant, uniform flow of developer material across its width to the photoconductor member by minimizing variations in developer delivery from the sump. Usually, a "metered flow" is obtained by utilizing a metering skive spaced uniformly from the toning shell parallel to the axis of rotation of the toning shell. Such a metered flow of developer on the toning shell insures that a uniform layer or "nap" of developer material of the proper thickness is delivered to the nip with the photoconductor member. If the nap is non-uniform, the resulting image may have streaks or other undesirable artifacts that degrade the quality of the image. If the developer nap is too thick, developer material can jam the nip and be expelled from the developer roller resulting in contamination of other areas of the electrophotographic reproduction apparatus. If the nap is uniform but too thin, there might not be enough toner present to enable a high quality image.

Producing acceptable image quality is made more complicated by the phenomena of developer break-in. Periodically, the developer needs to be changed in a high volume apparatus because of a deterioration of the characteristics of the carrier. A known problem associated with this change in developer is that there is a break-in period for the new developer after which the setpoints in the apparatus must be readjusted for best results. If the ultimate setpoints are used to start, the image shows substantial mottle. If the setpoints are chosen to work well with fresh developer, the images gradually lose density as the developer is "broken in."

As previously indicated, past attempts at providing a metered flow of developer material have included the use of a metering skive across the toning shell downstream from the line of developer delivery between the conveyor roller and the toning shell. The skive gap and its relationship to the toning shell must be tightly controlled to achieve both a uniform thickness of the developer nap along the axis of rotation of the developer roller, and a desired thickness that is neither too thick or too thin. Even very small errors in the metering skive gap can result in an unacceptably large error in either the nap uniformity or nap thickness of the developer. Accordingly, when a metering skive is used, it is positioned at the point of the lowest magnetic field strength from the developer roller's magnetic core. It has been found that such positioning significantly decreases the sensitivity of developer nap height to the metering skive gap by a factor of two to four times. This makes the metering skive gap easier to setup in manufacturing and the resulting developer nap thickness less sensitive to differences in that skive gap along the length of the developer roller.

However, the applicants have observed multiple disadvantages associated with such metering skives. First, such metering skives limit the printing speed that can be achieved by the photoconductor member, as they necessarily impose a limit on the amount of developer that the toning shell can deliver to the photoconductor member. Second, the positioning of such skives at the preferred point of the lowest magnetic field strength from the developer roller's magnetic core requires the developer to be applied a relatively large angular distance of nearly 180° away from the line of closest approach between the toning shell and the photoconductor element. Such a large angular distance results in a relatively long residence time for the developer on the toning shell. The applicants have observed that such a relatively long residence time in combination with the rapid rotation of the magnetic core of the brush to achieve high printing speeds can disadvantageously age the developer, rendering it less effective in developing the electrostatic latent image on the photoconductor member. Third, the metered flow obtained with the metering skive is sensitive to the uniformity of the material delivered by the conveyor roller. Fourth, the metering skive spacing is typically set at a fixed spacing that does not take into account developer break in or developer deterioration.

SUMMARY OF THE INVENTION

To solve these and other problems, the developer system of the invention includes the combination of (1) a self-metering conveyor roller having a magnetic core and an outer shell for conveying developer from the reservoir of said sump to said toning shell of said magnetic brush, wherein a maximum magnetic field strength of said outer shell is less than 1000 gauss and preferably less than 300 gauss, and a minimum magnetic field strength between magnetic poles of said outer shell is no less than about 30% of said maximum field strength, and (2) a driving assembly that rotates the conveyor roller from a minimum speed for feeding developer to a speed that saturates the capacity of the toning shell such that that a constant, high flow rate of developer is provided to the toning shell despite variations in the attraction and transport of developer from the sump by said conveyor roller. The driver assembly and the conveyor roller speed are controlled by a controller to maintain image quality, and in particular, to maintain image density within acceptable limits.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1A:
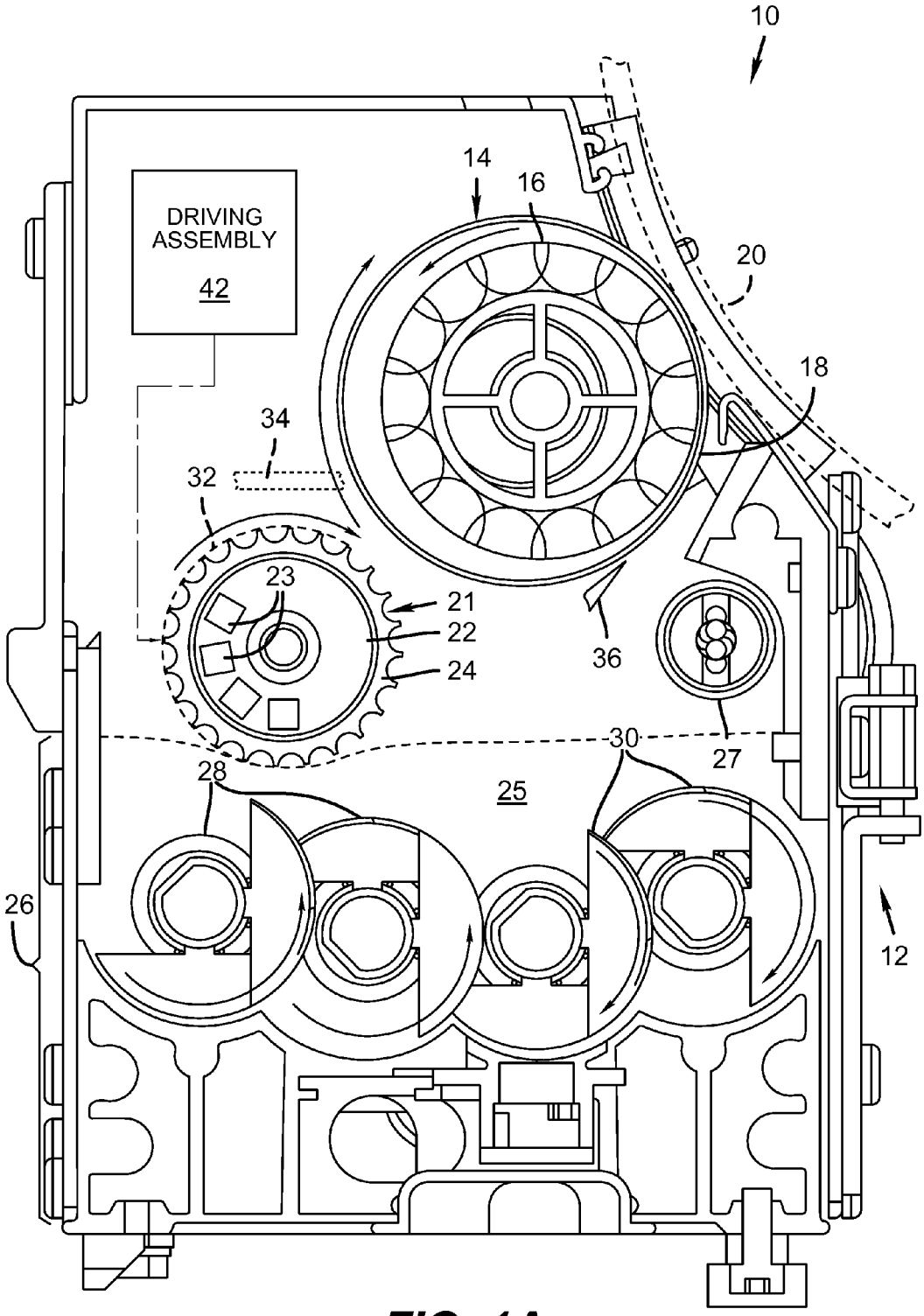
FIG. 1A is a schematic side view of a typical electrographic development station suitable for use with the development station improvements of the invention.

FIG. 1A illustrates a developer station 10 that the invention is applicable to. Such a developer station 10 includes a housing 12. A developer roller or magnetic brush 14, mounted within the development station housing 12, includes a rotating (counterclockwise in FIG. 1A) fourteen pole magnetic core 16 inside a rotating (clockwise in FIG. 1A) toning shell 18. Of course, the core magnet 16 and the shell can have any other suitable relative rotation. The rotating toning shell 18 applies developer to the outer surface of a drum-shaped photoconductor element 20 shown in phantom in order to develop latent electrostatic images written on the drum by an optical writing station (not shown). A magnetic conveyor roller 21 having a stationary core 22 surrounded by a rotatable shell 24 delivers developer 25 from a developer reservoir or sump 26 located at the bottom of the housing 12 to the back side of the toning shell 18. In the preferred embodiment, shell 24 is approximately 1.20 inches in diameter. A toner replenishing tube 27 delivers toner to the developer 25 in the reservoir 26 to maintain a proper ratio of toner and transport particles in the developer 25. Feed augers 28 having suitable mixing paddles (rotating counterclockwise) mix toner from the tube 28 with the developer in the reservoir 26, while return augers 30 mix toner-depleted developer removed from the toning shell 18 by stripping skive 36 back into the developer reservoir. A conveyor roller controller and driving assembly 42 is operably connected to the shell 24 of the conveyor roller and controls the speed of rotation of the shell 24. While not shown in detail, the conveyor roller controller and driving assembly may include an electric motor, a densitometer for measuring image density and image quality, a digital controller that controls the speed of the motor by controlling the amount of current conducted thereto, and a gear train.

Figure 1B:
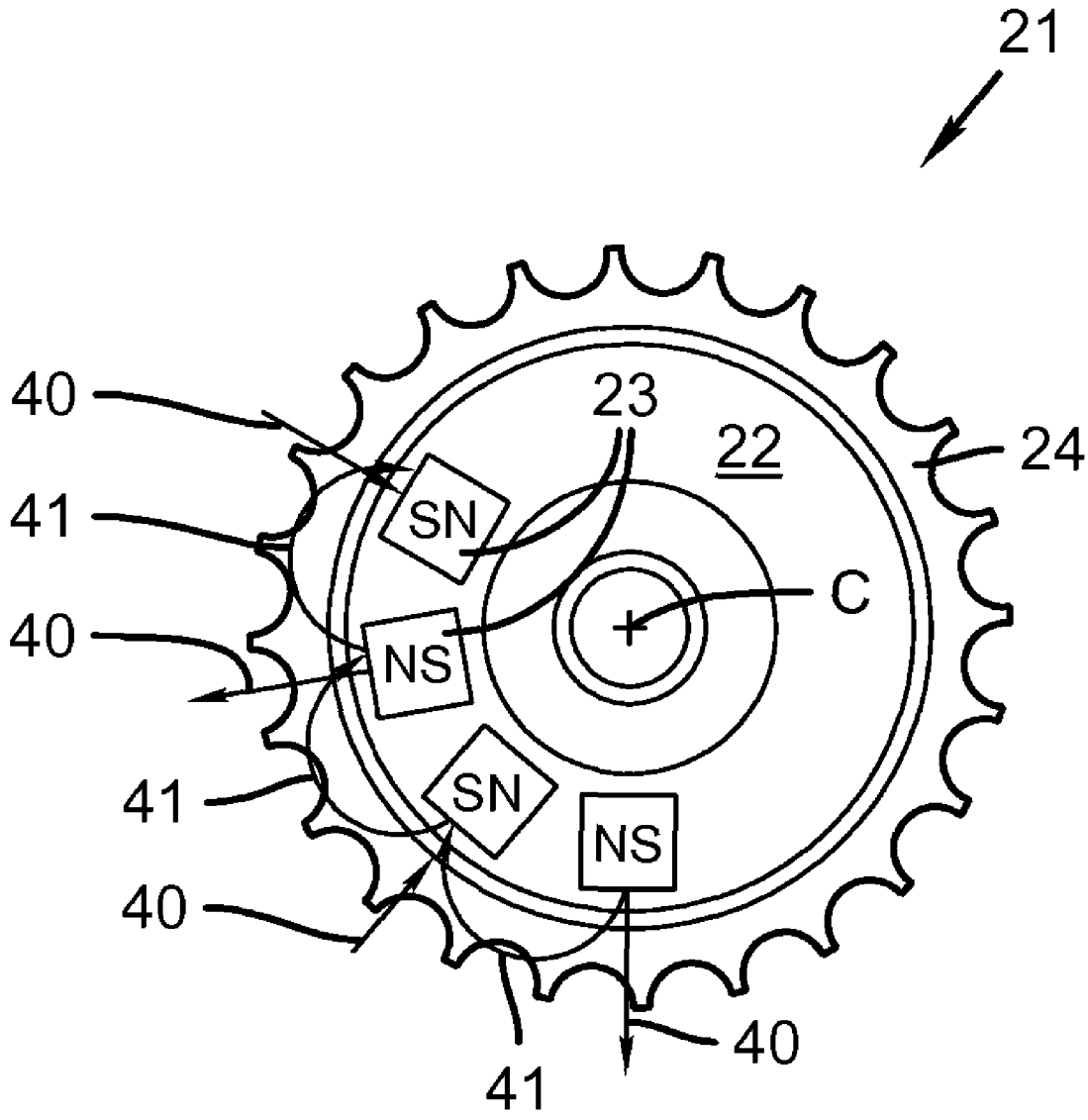
FIG. 1B is a cross sectional side view of the conveyor roller of the invention, schematically illustrating the distribution of the magnetic poles in the roller magnetic core and schematically illustrating the lines of flux therebetween.

With reference now to FIG. 1B, the stationary core 22 of the conveyor roller 21 preferably includes at least two magnets and preferably at least four magnets 23 arranged around the circumference of the core 22 between the six o'clock position and about the ten or eleven o'clock position as shown. Although individual magnets are shown, the stationary core can also include a single piece of magnetic material that is magnetized to produce a similar magnetic field. The poles of the magnets 23 are further arranged so that they alternate N-S-N-S from the six and ten-eleven o'clock position, although they could just as easily alternate in an S-N-S-N pattern. The radial vector 40 of each of the fields of the magnetic poles is radially aligned with respect to a central axis C of the cylindrical core 22. Tangential field lines 41 interconnect the alternating poles of the magnets 23 as shown. As is described in more detail hereinafter, the magnets 23 provide a maximum combined radial and tangential magnetic field strength at the outer surface of the rotating shell 24 of preferably between about 100 and 300 gauss, and more preferably between about 150 and 250 gauss, and most preferably of about 200 and 250 gauss. Additionally, the minimum tangential magnetic field strength between magnetic poles 23 around the outer surface of the rotating shell 24 is preferably no less than about 30% of the maximum radial field strength, and more preferably no less than about 35-50% of the maximum radial field strength. In the preferred embodiment, magnets 23 are flexible strip-type magnets formed from a mixture of magnetic particles mixed with a plastic material. Such magnets having the required field strengths are commercially available, and are easy to cut to the sizes required for the manufacture of the roller 21.

In operation, the shell 24 of the conveyor roller 21 is rotated clockwise by the driving assembly 42 at speeds ranging from a minimum speed necessary to feed developer to at least a speed that saturates the capacity of the toning shell to receive and convey developer to the photoconductor element 20. Core 22 remains stationary. The magnet 23 disposed in approximately the six o'clock position is adjacent the developer reservoir 26 and draws the magnetic developer 25 onto the outer surface of the shell 24 as shell 24 rotates, forming a layer 32 of developer on the shell 24. The field applied by the magnets 23 in combination with the rotational speed of the shell 24 provides a uniform thickness to the layer 32 as it rotates upwardly. The outer surface of the shell 24 includes a sprocket-like pattern of ridges and grooves as shown to enhance the grip that the shell 24 applies to the layer 32 of developer. While the average diameter of the shell 24 is 1.20 inches, the diameter varies from 1.27 to 1.15 inches between the ridges and grooves.

The developer layer 32 is delivered to a back portion of the toning shell 18 of the magnetic brush 14. A metering skive 34 (illustrated in phantom) can be provided immediately downstream of the line where the conveyor roller 21 delivers developer to the toning shell 18. The gap between the metering skive 34 and the toning shell 18 is carefully calibrated to ensure that the layer 32 of developer delivered to the photoconductor element 20 has a uniform nap of the proper thickness to produce acceptable image quality for a typical developer. However it is advantageous to adjust the flow for a new developer or for an old developer by changing the conveyor roller speed to maintain acceptable image quality and to maintain image density within acceptable limits. This can be done either within a metering skive present or with a self-metering conveyor roller that does not require a metering skive to produce a uniform layer of developer on the toning shell.

For a developer station 10 employing conventional conveyor roller and a metering skive 34, specific examples of magnetic brush core and developing shell speeds, conveyor roller speeds, auger rotational speeds, metering skive and takeoff skive gaps with respect to the toning shell are given below for printer speeds of 70 ppm, 83.3 ppm and 100 ppm, respectively:

TABLE 1

| Parameter | Low | Nominal | High | Units |
|---|---|---|---|---|
| | | 70 PPM | | |
| Core Speed | | 800 | | RPM |
| Shell | | 82 | | RPM |
| Conveyor | | 60 | | RPM |
| Mixer | | 436 | | RPM |
| Metering Skive Spacing | 0.033 | 0.035 | 0.037 | inches |
| Take-off Skive Spacing | 0.007 | 0.012 | 0.017 | inches |
| Process speed | | 11.8 | | ips |
| | | 83.3 PPM | | |
| Core Speed | | 952 | | RPM |
| Shell | | 97.58 | | RPM |
| Conveyor | | 71.4 | | RPM |
| Mixer | | 519 | | RPM |
| Metering Skive Spacing | 0.033 | 0.035 | 0.037 | inches |
| Take-off Skive Spacing | 0.007 | 0.012 | 0.017 | inches |
| Process speed | | 14.0 | | ips |
| | | 100 PPM | | |
| Core Speed | | 1142.9 | | RPM |
| Shell | | 117.1 | | RPM |
| Conveyor | | 85.7 | | RPM |
| Mixer | | 623 | | RPM |
| Metering Skive Spacing | 0.033 | 0.035 | 0.037 | inches |
| Take-off Skive Spacing | 0.007 | 0.012 | 0.017 | inches |
| Process speed | | 16.9 | | ips |

Surface speed of the rollers can be calculated from the roller speed in rpm using the diameter of the roller. For example, at 70 ppm printing speed, a toning shell with a 2 inch diameter rotating at 82 rpm has a surface speed in inches per second (ips) of $8.6=2\pi\times82/60$. The conveyor roller rotating at 60 rpm with a 1.27 inch maximum diameter has a maximum surface speed of 4 ips$=1.27\pi\times60/60$, and so forth for surface speeds of toning station components at other printing speeds. Toning shell speed is approximately 10.2 ips at 83.3 ppm and approximately 12.3 ips at 100 ppm.

Figure 2:
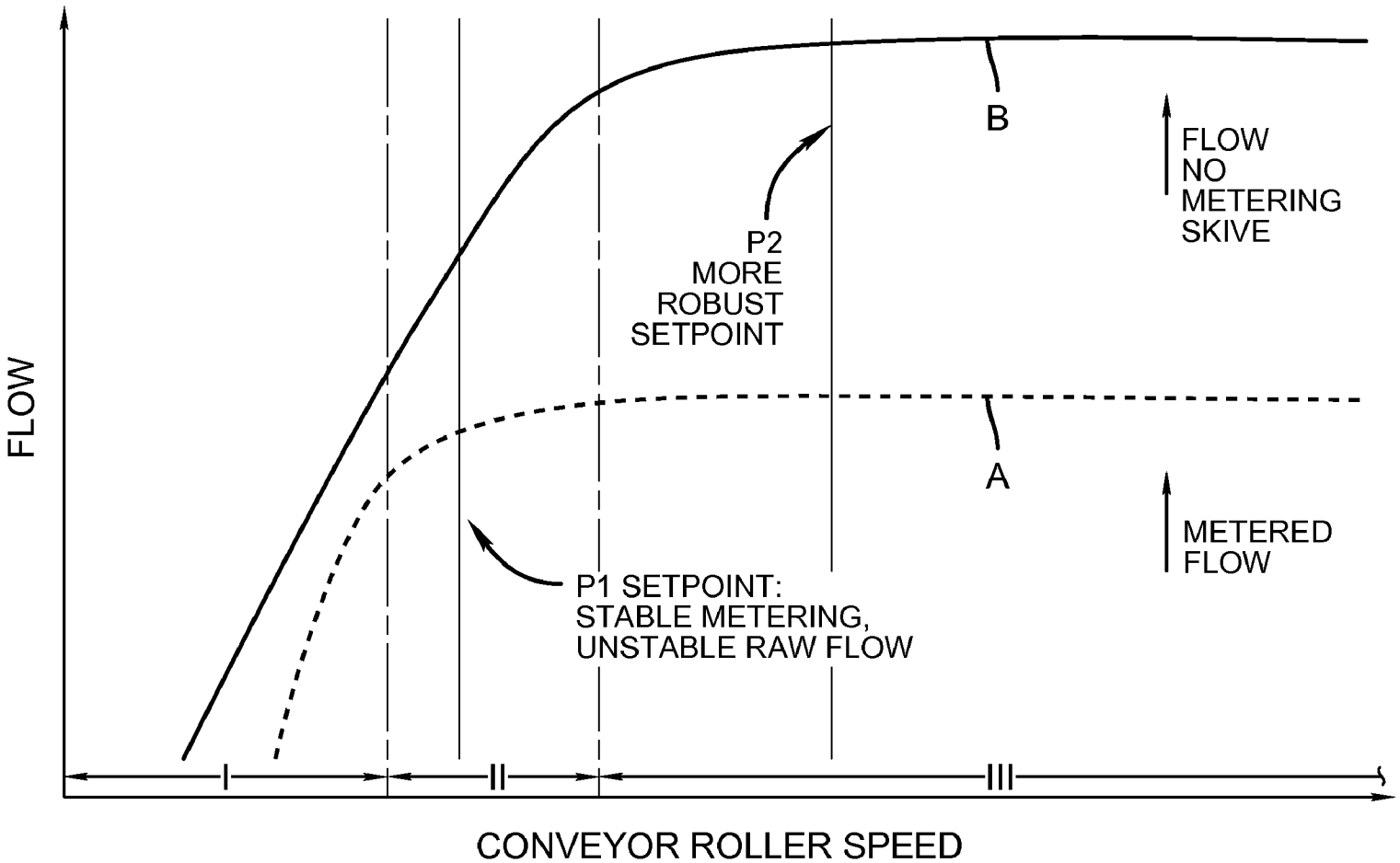
FIG. 2 is a schematic diagram of developer flow as a function of development station set points.
Figure 3:
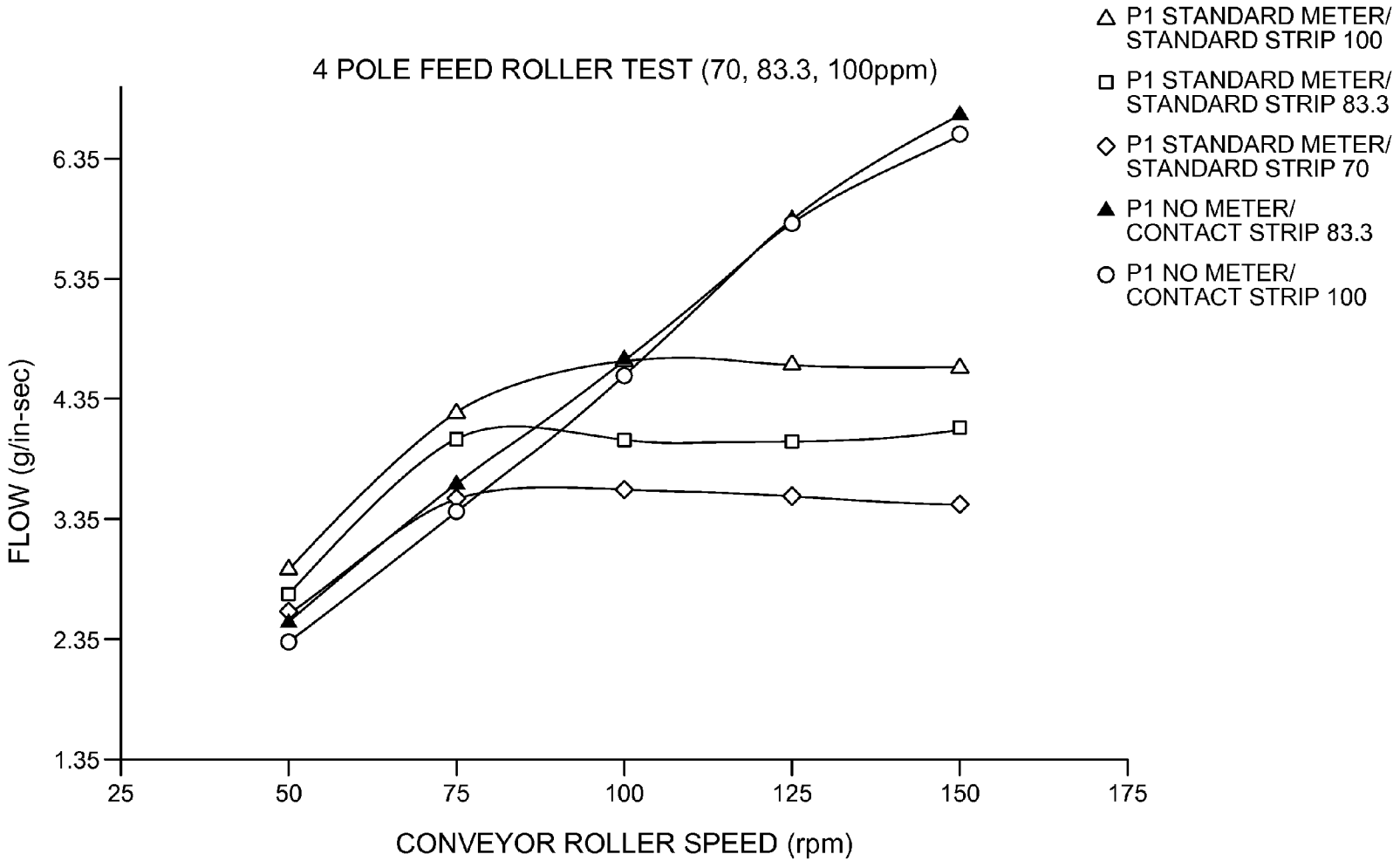
FIG. 3 is a graph of measured developer flow as a function of developer station set points for a first conveyor roller.

FIG. 2 is a schematic drawing showing developer flow in a developer station 10 as a function of the rotational speed of a conveyor roller. The dashed-line lower curve A in FIG. 2 shows the flow measured on the toning shell 18 with a metering skive 34 in place, and with a conveyor roller. At rotational speeds lower than P1, the conveyor roller delivers a raw flow of developer to the toning shell 18 that varies with the rotational speed of the roller. At rotational speeds greater than P1, the conveyor roller delivers a metered, constant flow of developer indicated by the flattening of the dashed line curve. This metered flow of developer remains substantially constant despite variations in the amount of developer transported from the sump from causes including variation of the rotational speed of the conveyor roller after P1. The solid-line upper curve B in FIG. 2 shows the flow measured on the toning shell 18 without a metering skive 34. At rotational speeds lower than P2, the conveyor roller 21 delivers a flow of developer to the toning shell 18 that varies with the rotational speed of the roller. At rotational speeds greater than P2, the conveyor roller 21 delivers a stable, constant flow of developer indicated by the flattening of the solid-line curve that is substantially greater than the metered flow achieved with a metering skive 34. This stable flow of developer remains substantially constant despite variations in the amount of developer transported from the sump from causes including variation of the rotational speed of the conveyor roller after P2. FIG. 2 can be divided into three regions. In Region I, both non-metered flow (solid line) and metered flow utilizing a skive (dashed line) increase proportionally with conveyor roller speed. In Region II, raw and metered flow approach saturation. In Region III, both raw flow and metered flow are saturated, and independent of conveyor roller speed. The present invention consists of setpoints for which the raw flow increases with increasing conveyor roller speed, as shown in Regions I and II of FIG. 2. A metering skive can be used to control flow to acceptable levels below a limit at which developer jams the nip and is expelled from the developer roller FIG. 3 is a graph illustrating the performance of a first conveyor roller that is capable of operating in Region I and Region II of FIG. 2, but not Region III. The vertical axis indicates the developer flow rate to the photoconductor element 20 in grams per inch-second or g/(in.-sec.) in a direction perpendicular to the axis of rotation of the toning shell 18, while the horizontal axis indicates the rotational speed of a first conveyor roller in revolutions per minute (rpm). The lower three curves (indicated by diamonds, squares and triangles) plot developer flow rate as a function of conveyor roller speed when a metering skive 34 is present in the developer station 10 for printing speeds of 70 pages per minute (ppm), 83.3 ppm and 100 ppm respectively. Stable, metered flow occurs with the combination of a prior art conveyor roller and a metering skive 34 at all three printing speeds at about 100 rpm to 150 rpm. The upper two curves (indicated by short and long dash marks) plot developer flow rate as a function of conveyor roller speed when a metering skive is not present in the developer station 10 for printing speeds of 83.3 ppm and 100 ppm respectively. Note that the flow of developer can be controlled by changes in conveyor roller speed for this range of roller speeds with such a roller when the metering skive is not present. Flow rate is proportional to conveyor roller speed for rotational speeds up to 150 rpm with no indication in either of the top curves of a stable plateau being reached.

Figure 4:
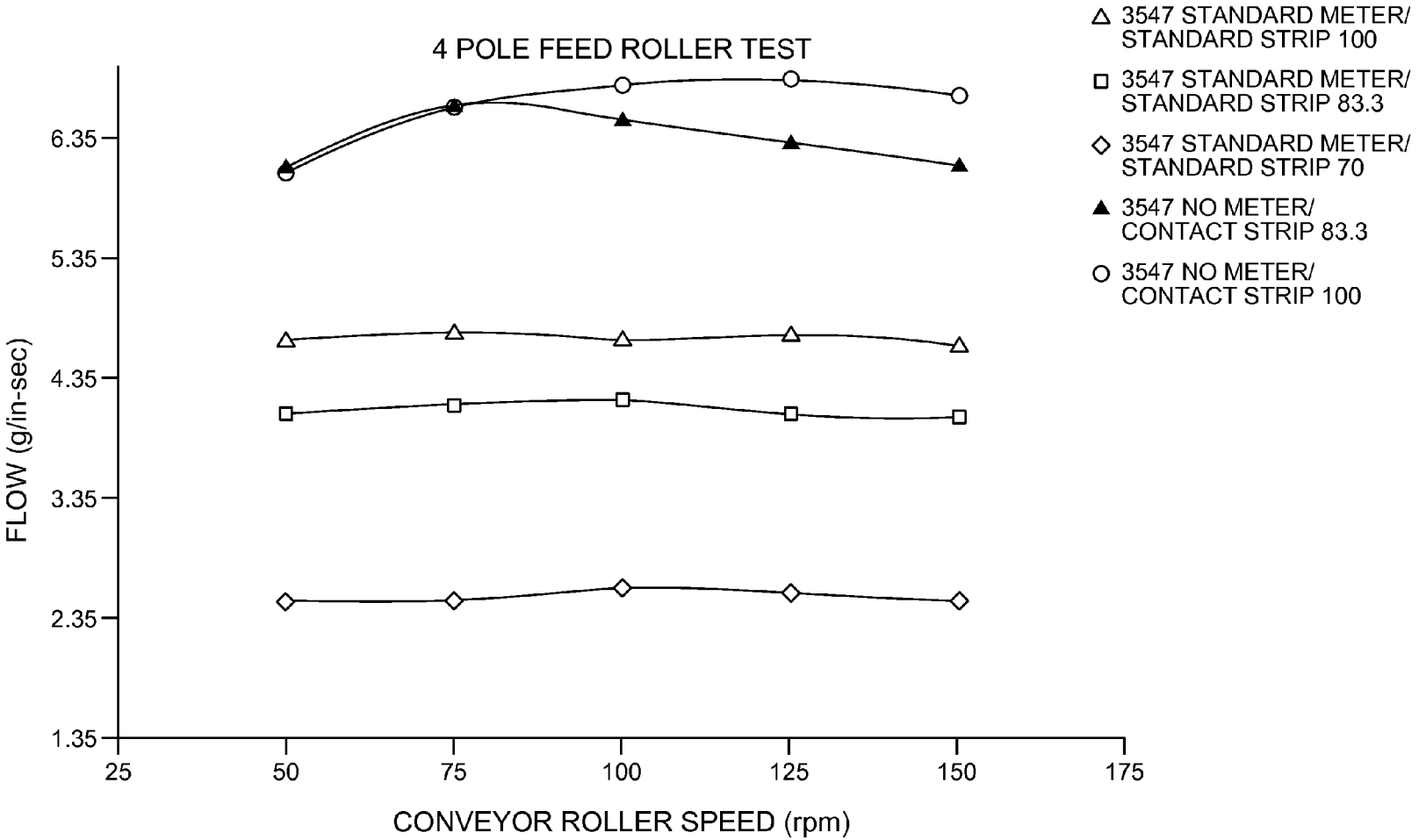
FIG. 4 is a graph of measured developer flow as a function of developer station set points second conveyor roller.

FIG. 4 shows the performance of a second conveyor roller 21 compared to that of a first roller shown in FIG. 3. The second conveyor roller is capable of operating in Region III, where stable metered flow and stable non-metered flow are obtained for a range of conveyor roller speeds. Specifically, the upper two curves indicated by short and long dashes plot developer flow rate as a function of conveyor roller speed when a metering skive is not present and a second conveyor roller 21 is used in the developer station 10 for printing speeds of 83.3 ppm and 100 ppm, respectively. These two curves show that stable flow of developer that is robust to changes in conveyor roller speed or other fluctuations in the instantaneous rate of developer transport is achieved with the second roller 21 when the metering skive is not present. The non-metered flow varies by less than plus or minus 10% for conveyor roller speeds of 50 to 150 rpm, a speed range of 6.6 ips conveyor roller surface speed for toning shell speeds of 10.2 to 12.3 ips. The conveyor roller speed range that provides stable non-metered flow is more than 50% of the toning shell speed. The lower three curves indicated by diamonds, squares, and triangles plot developer flow rate as a function of conveyor roller speed when a metering skive 34 is present in the developer station 10 for printing speeds of 70 pages per minute (ppm), 83.3 ppm and 100 ppm respectively. The flatness of these three curves indicates that the combination of the second conveyor roller and metering skive also provides a stable, metered flow of developer despite variations in the rotational speed of the roller or transport of the developer from the sump.

Figure 5:
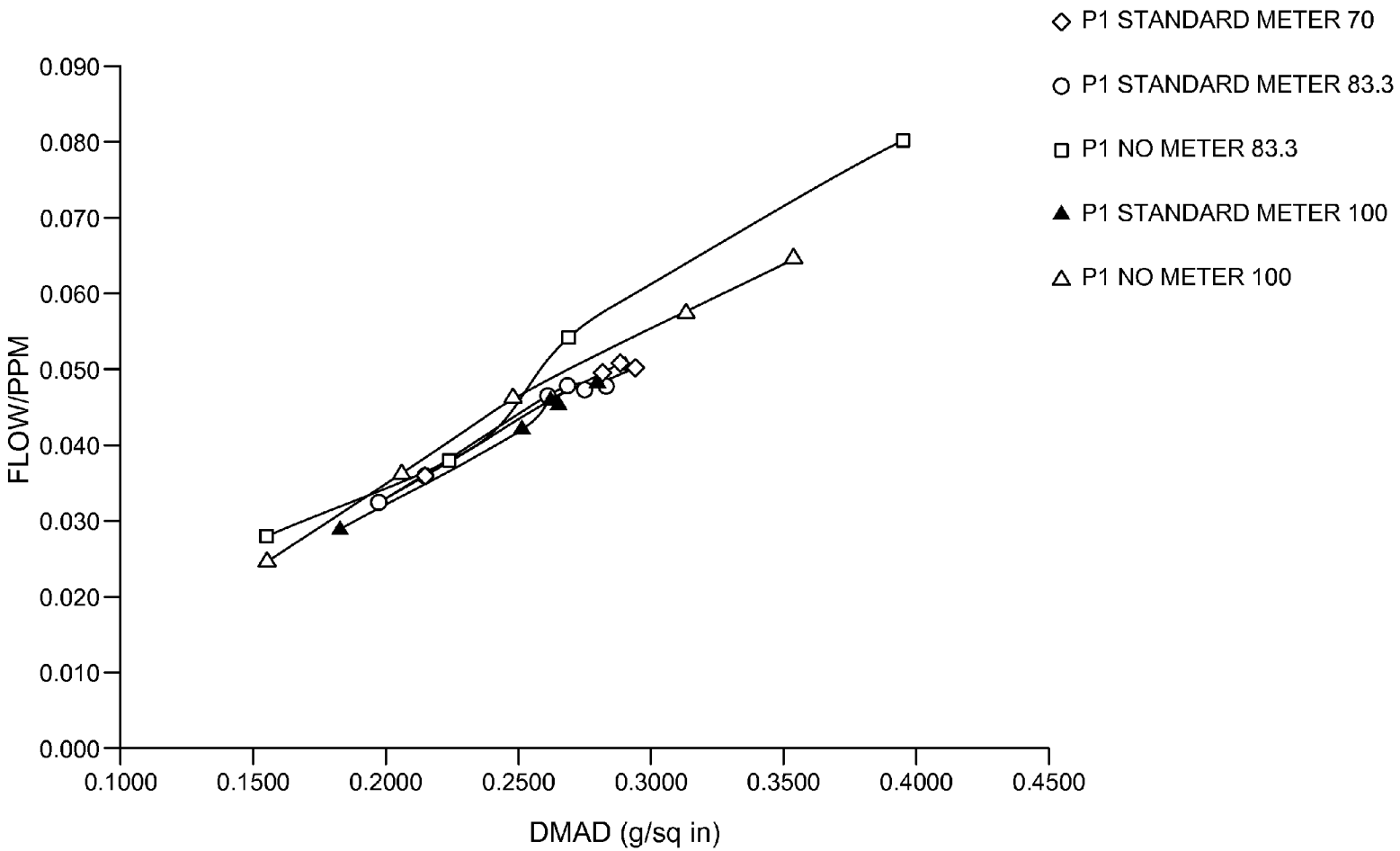
FIG. 5 is a graph of measured developer flow vs. developer mass area density as a function of developer station set points for a first conveyor roller.

Indication of the controllability of flow by conveyor roller speed is provided by the data of FIG. 4 and analysis of FIG. 5, which shows the performance obtained with the first conveyor roller. In FIG. 5, the developer flow normalized by printer speed in pages per minute (flow/ppm) and developer mass area density on the toning shell (DMAD) in units of g/(sq in) are plotted for the first conveyor roller. All normalized flow curves for metered and non-metered flow at 70, 83.3, and 100 ppm fall on nearly the same diagonal line, indicating that, at all printing speeds tested, flow is a linear function of developer mass area density. For flow with a metering skive spacing of 0.035 in., flow/ppm increases proportionally with DMAD as conveyor roller speed is increased until an upper limit is reached for DMAD. This limit in DMAD and flow is caused by the metering skive spacing. FIG. 5 also shows indirectly that flow is directly proportional to toning roller magnetic core speed and shell speed, as these speeds were increased proportionally to obtain greater printing speed, and flow normalized by printing speed (flow/ppm) is approximately the same for all toning station settings at the same DMAD.

FIG. 5 also shows, for the curves corresponding to metered flows and non-metered flows obtained without a metering skive, that a range of flows and DMAD can be obtained by increasing or decreasing conveyor roller speed at all printing speeds tested. With the first conveyor roller, normalized metered flows of approximately 0.04 to 0.05 g/(in sec) per ppm are used at 70, 83.3 and 100 ppm printing speed. These flows are obtained at the standard metering skive spacing of 0.035 inches. If the first conveyor roller is used without a metering skive, normalized flow of approximately 0.65 to 0.80 g/(in.-sec.) per ppm can be obtained by increasing or decreasing conveyor roller speed. The maximum conveyor roller speed tested was150 RPM.

For the second conveyor roller 21, both metered and non-metered flow is constant as a function of conveyor roller speed, as shown in FIG. 4. This shows the maximum flow rates obtainable by saturating the developer layer on the toning shell for print speeds to 100 ppm. The flow data for the second conveyor roller shown in FIG. 4 can be normalized by dividing by printing speed in ppm. Normalized non-metered flows (flow/ppm) average 0.07 g/(in sec) per ppm for the full range of conveyor roller speeds from 50 to 150 rpm for printing speeds of 83.3 and 100 ppm. This is almost 50% more than the normalized flow rate used for the first roller for printing speeds up to 100 ppm. Normalized metered flow for the second conveyor roller is approximately the same as the prior art roller. 0.04 to 0.05 g/(in.-sec.) per ppm.

Figure 6A:
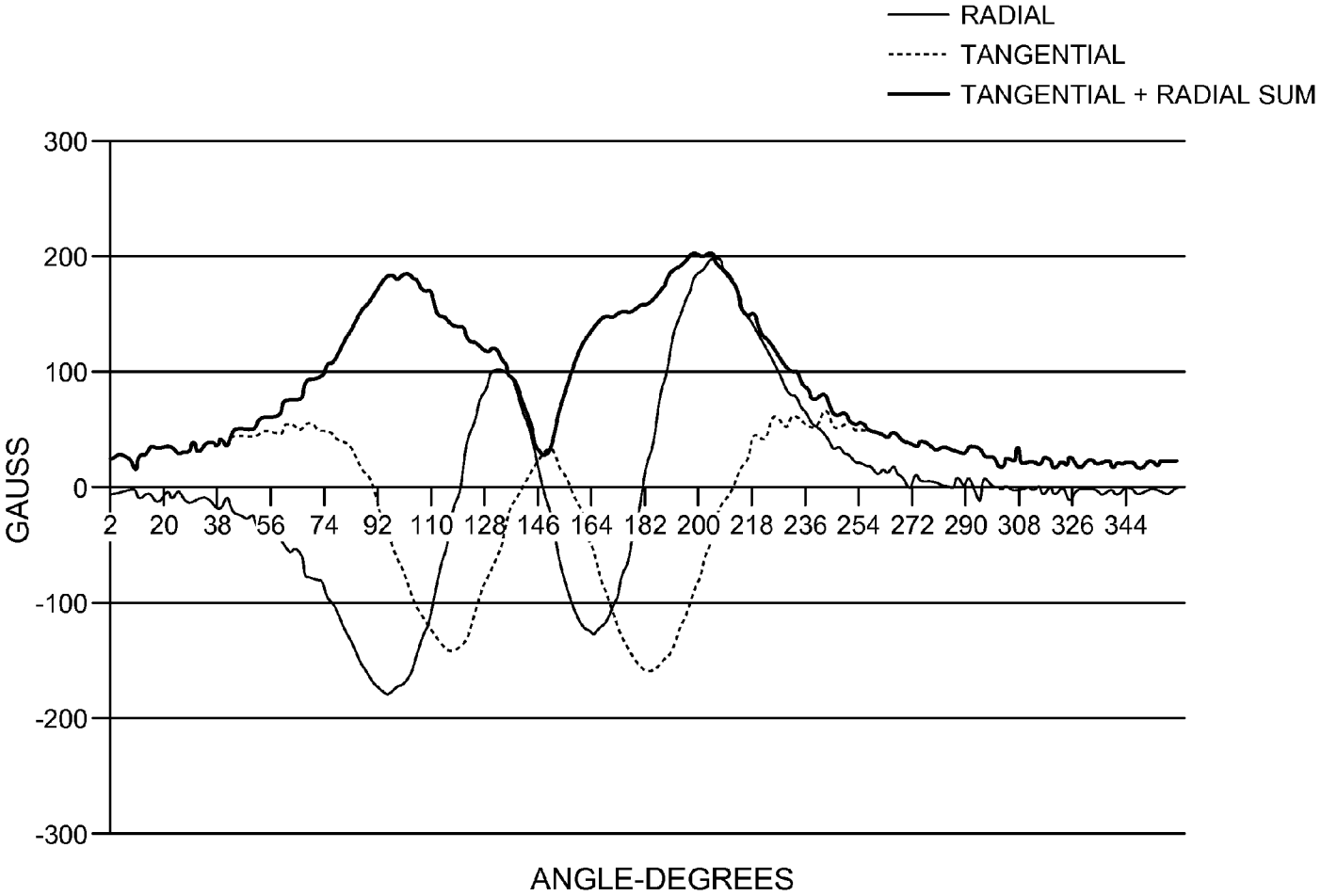
FIG. 6A is a plot of the magnetic field of a first conveyor roller.
Figure 6B:
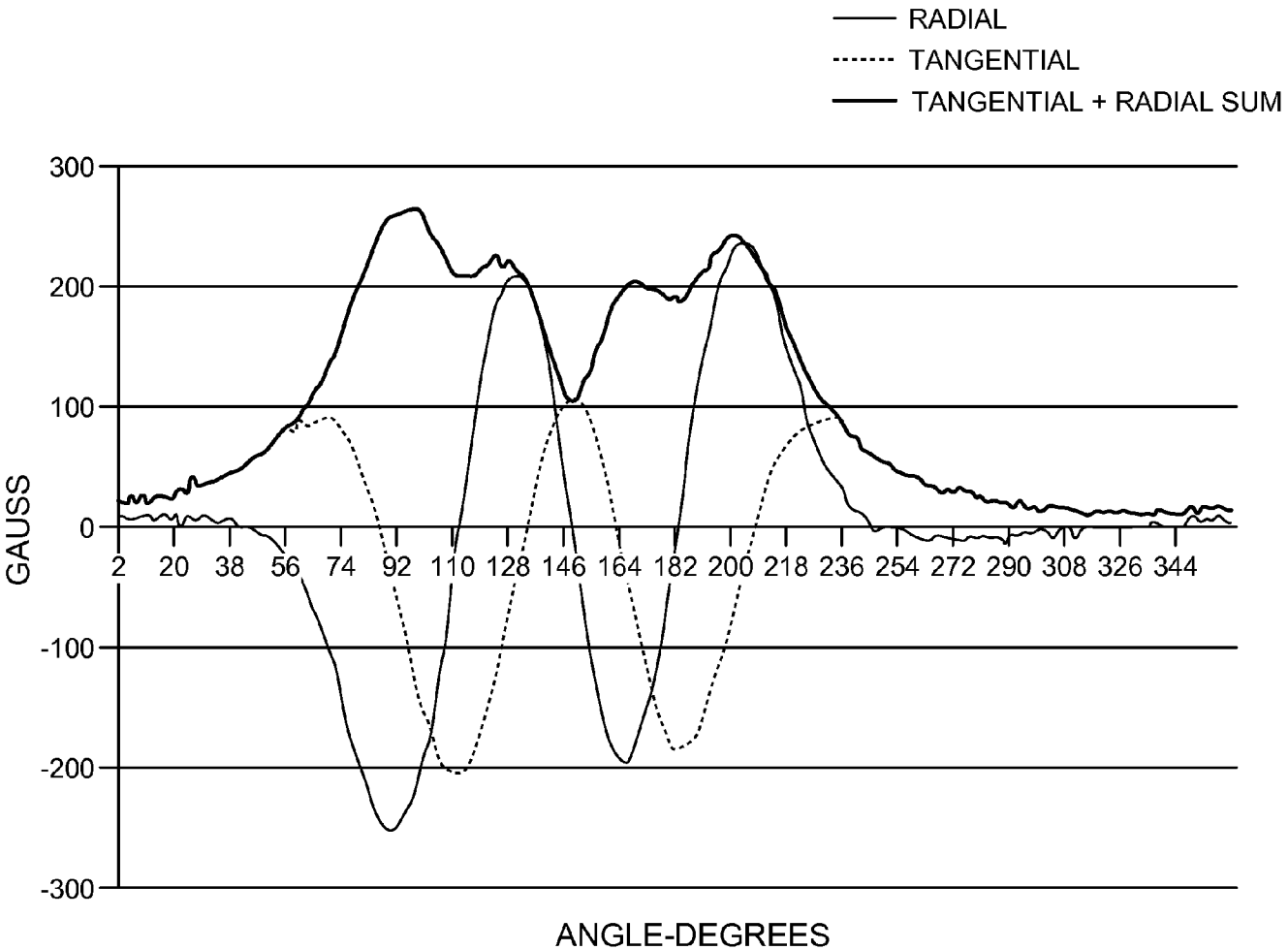
FIG. 6B is a plot of the magnetic field of a second conveyor roller.

FIGS. 6A and 6B compare the magnetic field strengths at the surface of the rotatable shell 24 of a conveyor roller 21 between a first four-magnet conveyor roller and the second conveyor roller respectively. In both graphs, the vertical axis is calibrated in gauss while the horizontal axis is calibrated in angular degrees. Both the first conveyor roller and the second conveyor roller utilize four magnetic poles uniformly spaced around the magnetic core 22 of the roller between the six and ten-eleven o'clock positions. The poles of the magnets are radially aligned with the central axis C of the core 22 as illustrated in FIG. 1B. The magnetic field on the surface of the rotating shell 24 is the resultant sum of the radial and tangential components schematically shown by force vectors 40 and 41 illustrated in FIG. 1B. The strength of the radial and tangential field components is plotted at each angular point around the shell 24 by the thin solid line and dotted line in FIGS. 6A and 6B, respectively. In both graphs, the radial field strength is characterized by peaks and valleys as a result of the alternating polarity of the magnets 23. The tangential field strength also undulates, and maximizes or minimizes at the zero crossing points of the radial field strength. The resultant field strength is illustrated by the bold solid line of both graphs. The magnetic field of the first conveyor roller is less than the magnetic field of the second roller where a useful field of at least 100 gauss is present.

In generating and plotting the data illustrated in FIGS. 6A and 6B, the applicants discovered two unexpected characteristics in the magnetic fields surrounding conveyor rollers that contributed to the development of the claimed invention. First, the graph of FIG. 6A indicates that a precipitous minimum field strength occurs between the two middle magnets 23 located at about the seven and nine o'clock positions in the first conveyor roller. Specifically, this graph shows that a maximum field strengths of 190 and 200 gauss occur at about 94° and 200°, respectively, but that a minimum field strength of only about 30 gauss occurs at about 150°. Stated somewhat differently, the graph of FIG. 6A indicates that the minimum field strength in the array of the magnets 23 is only 15% of the maximum field strength. The applicants have further observed that such relatively low field strength in the middle of the array of magnets 23 creates what amounts to a "hole" in the field which substantially compromises the ability of the first conveyor roller 21 to transport developer. Second, the graph of FIG. 6B indicates that the percentage difference between the maximum and minimum field strengths can be largely remedied by only a relatively moderate increase in the magnetic field strength of the magnets 23. Specifically, the applicants discovered that if the tangential field strength of the magnets 23 between the two center magnets is increased from 30 gauss to 100 gauss the minimum field strength increases to 100 gauss, which is 38% of the maximum field strength. Hence by increasing the tangential field strength only 70 gauss, the ratio of minimum to maximum field strength increases by a factor of 250% (i.e. from 15% to 38%).

The invention has been described in detail with particular reference to certain preferred embodiments thereof, but it will be understood that variations and modifications can be effected within the spirit and scope of the invention.

What is claimed is:

1. A developer system for an electrographic printer having a photoconductor element, comprising:

a magnetic core surrounded by a toning shell that rotatably conveys a layer of developer to said photoconductor element;

a sump containing a reservoir of developer;

a conveyor roller for conveying developer from the reservoir to said toning shell, said conveyor roller having a magnetic core generating a magnetic brush having at least two magnetic poles of opposite polarity;

a driving assembly that rotates the conveyor roller at a variable speed; and a conveyor roller controller to control developer flow by varying the speed of the conveyor roller, such that the conveyor roller controller is capable of decreasing the speed of the conveyor roller as a function of time.

2. The developer system of claim 1, wherein a first magnetic field strength of an outer surface of the conveyor roller is less than 1000 gauss, and a second magnetic field strength between poles at said outer surface is no less than 30% of said maximum field strength.

3. The developer system of claim 1, wherein conveyor roller speed is controlled to maintain image quality.

4. The developer system of claim 1, wherein conveyor roller speed is controlled to maintain image density within acceptable limits.

5. The developer system of claim 1, wherein the maximum magnetic field strength of the outer surface of the conveyor roller is between about 100 and 300 gauss, and a minimum magnetic field strength of said outer surface is no less than about 35% of said maximum field strength.

6. The developer system of claim 1, wherein said magnetic core of said conveyor roller includes a plurality of magnets around the circumference of the roller, the poles of each of said magnets being radially aligned with respect to a central axis of said roller and alternating between adjacent magnets.

7. The developer system of claim 6, wherein said conveyor roller includes a cylindrical shell rotatably mounted around said magnetic core of said conveyor roller, and wherein said magnets extend around between about 100° and 160° around said circumference of the magnetic core of said conveyor roller.

8. The developer system of claim 6, wherein said magnets are flexible strip magnets.

9. The developer system of claim 6, wherein said magnetic core of said conveyor roller includes an even number of magnets.

10. The developer system of claim 1, further comprising means for driving said magnetic brush consistent with a printing speed of at least 80 ppm.

11. The developer system of claim 1, further comprising means for rotating said conveyor roller at a speed that delivers developer at a rate of at least 5.0 g/in.-sec.

12. The developer system of claim 11, further comprising means for rotating said conveyor roller at a speed that delivers developer at a rate of at least 5.35 g/in.-sec.

13. The developer system of claim 12, wherein said rotating means rotates said conveyor roller at a speed of at least 75 rpm.

14. A developer system for an electrographic printer having a photoconductor element, comprising:

a magnetic core surrounded by a toning shell that rotatably conveys a layer of developer to said photoconductor element;

a sump containing a reservoir of developer;

a conveyor roller for conveying developer from the reservoir to said toning shell said conveyor roller having a magnetic core generating a magnetic brush having at least two magnetic poles of opposite polarity;

a driving assembly that rotates the conveyor roller at a variable speed; and a conveyor roller controller to control developer flow by varying the speed of the conveyor roller wherein the driving assembly that rotates the conveyor roller up to a saturation speed that saturates the capacity of the conveyor roller to deliver developer to said toning shell such that the flow of developer on the toning shell is essentially constant when the conveyor roller speed is increased beyond the saturation speed and engages a metering skive such that the flow on the toning shell is less if the metering skive is engaged.

15. A developer system for an electrographic printer having a photoconductor element, comprising:

a magnetic core surrounded by a toning shell that rotatably conveys a layer of developer to said photoconductor element;

a sump containing a reservoir of developer;

a conveyor roller for conveying developer from the reservoir to said toning shell said conveyor roller having a magnetic core generating a magnetic brush having at least two magnetic poles of opposite polarity;

a driving assembly that rotates the conveyor roller at a variable speed; and a conveyor roller controller to control developer flow by varying the speed of the conveyor roller with a metering skive set to limit flow below a maximum that would jam the skive.

16. A method of controlling a flow rate of developer to a toning shell of a magnetic brush that develops latent electrostatic images on a photoconductor element comprising the steps of:

providing a conveyor roller between a reservoir of developer and said toning shell, providing a range of magnetic field strengths on an outer surface of said roller having at least two magnetic poles of opposite polarity sufficient to produce developer flow from the reservoir to the toning shell;

rotating the conveyor roller at a controlled variable speed that is sufficient to maintain image quality; and engaging a metering skive.

17. The method of claim 16, the controlling further comprising changing the speed of the conveyor roller after the developer is replaced.

18. The method of claim 16, further comprising the step of rotating said conveyor roller at a speed that delivers developer at a rate of at least 5.0 g/in.-sec.

* * * * *